7/31/84 XR 4,463,049

United States Patent [19]

Kracke

[11] Patent Number: 4,463,049

[45] Date of Patent: Jul. 31, 1984

[54] SOUND-ABSORBING WALL-LINING

[75] Inventor: Wilhelm Kracke, Celle, Fed. Rep. of Germany

[73] Assignee: Dr. Alois Stankiewicz Schallschluck GmbH & Co., Fed. Rep. of Germany

[21] Appl. No.: 458,552

[22] Filed: Jan. 17, 1983

[30] Foreign Application Priority Data

Jan. 22, 1982 [DE] Fed. Rep. of Germany ... 8201510[U]

[51] Int. Cl.[3] ..... E04B 1/84; E04B 1/86; G10K 11/00

[52] U.S. Cl. ..... 428/281; 181/198; 181/204; 181/286; 181/290; 181/294; 428/282; 428/310.5; 428/317.9; 428/319.3

[58] Field of Search ..... 181/198, 204, 286, 290, 181/294; 428/281, 282, 310.5, 317.9, 319.3

[56] References Cited

U.S. PATENT DOCUMENTS

| | | | |
|---|---|---|---|
| 3,243,374 | 3/1966 | Gillard | 181/286 |
| 3,652,377 | 3/1972 | Helmick | 428/218 |
| 4,097,633 | 6/1978 | Focht | 181/286 |
| 4,131,664 | 12/1978 | Flowers et al. | 428/218 |
| 4,160,491 | 7/1979 | Matsumoto | 181/286 |
| 4,215,764 | 8/1980 | Marangoni et al. | 181/286 |
| 4,346,782 | 8/1982 | Bohm | 181/294 |
| 4,357,393 | 11/1982 | Tsuda | 181/294 |
| 4,367,259 | 1/1983 | Fulmer et al. | 428/283 |
| 4,374,172 | 2/1983 | Schwarz et al. | 181/294 |
| 4,397,894 | 8/1983 | Hains et al. | 181/294 |

FOREIGN PATENT DOCUMENTS

| | | | |
|---|---|---|---|
| 2437947 | 2/1976 | Fed. Rep. of Germany | 181/286 |
| 2744732 | 10/1979 | Fed. Rep. of Germany | 181/286 |
| 2834683 | 10/1979 | Fed. Rep. of Germany | 181/286 |
| 104528 | 8/1980 | Japan | 181/284 |

OTHER PUBLICATIONS

Fisher, *Materials In Design Engineering*, Oct., 1964, pp. 96–99.

*Primary Examiner*—James C. Cannon
*Attorney, Agent, or Firm*—Lewis H. Eslinger

[57] ABSTRACT

It should be possible to manufacture, in a simple manner, a sound-absorbing wall-lining (3) consisting of a material to be applied to the wall which needs lining, and a resilient layer (4, 5) of foam, e.g. foam rubber, felt, or similar material, having locally distinctive sound-absorbing capacities, and whose thickness will possibly remain uniform, provided the resilient layer (4, 5) contains a filler with locally distinctive degrees of cross-linking—corresponding to distinctive sound-absorbing capacities.

5 Claims, 2 Drawing Figures

SOUND-ABSORBING WALL-LINING

Figure 1:
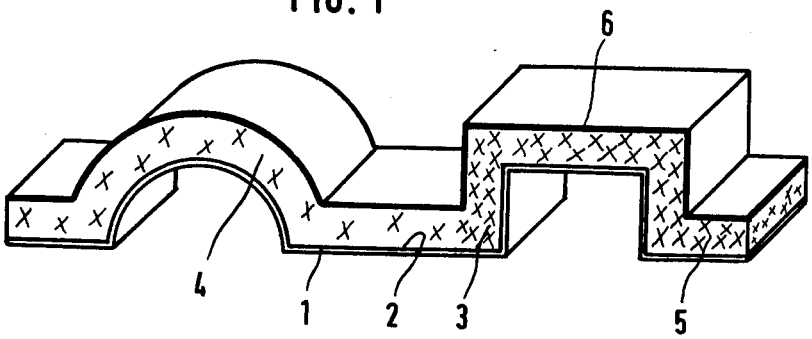

The invention concerns sound-absorbing wall-lining, or sound-absorbing panels, for cars, engines, or similar, consisting of a material to be applied to the wall which needs to be lined, and a resilient layer of foam, e.g. foam rubber, felt, or similar material, with locally distinctive sound-absorbing capacities.

It is a known procedure to cover surfaces in cars with sound-absorbing wall linings in order to create an acoustic insulation between two areas such as, for example, the engine compartment and the passenger compartment. During research concerning the total weight reduction of cars, it was established that certain surface areas are easier to insulate acoustically than others, i.e. they require a sound-absorbing wall-lining with a lower sound-absorbing capacity than is needed for other surface areas. Rather than having to resort to wall-lining with uniform sound-absorbing properties, we now know that, according to DE-OS No. 28 00 914, it is possible to distribute the material in a purposeful manner, i.e. by creating a sound-absorbing wall-lining of different thicknesses. In this process, the layers themselves consist of substances with a homogeneous composition, and the wall-lining is created by applying it in greater thicknesses in certain spots, or by applying several layers or several coats of wall-lining strips.

The disadvantages involved are that, on the one hand, the sound-absorbing wall-lining presents locally distinct thicknesses, which are necessary to achieve locally distinctive sound-absorbing capacities and that, on the other hand, there exists no simple, single procedure for manufacturing the wall-lining.

The objective of the invention is to create a sound-absorbing wall-lining in a simple manner, whose thickness is as uniform as possible, while presenting locally distinctive sound-absorbing capacities.

According to the invention, the objective is met by the fact that the resilient layer, e.g. the foam forming the resilient layer, contains a filler, and by the fact that it presents locally distinctive degrees of cross-linking which correspond to the sound-absorbing capacities.

For cross-linking the filler, it is preferable to use a polyol as cross-linking agent and to use locally distinctive mixture ratios which correspond to the sound-absorbing capacities.

A few applications are known whereby the sound-absorbing wall-lining, consisting of a material and a resilient layer, is in addition, soaked in a bitumenous substance, whereby the resilient layer—which is in itself elastic and consists of felt, foam rubber, or similar—becomes increasingly plastic, without losing its elasticity entirely, i.e. after some time, the resilient layer, e.g. foam, will recover.

If, on the other hand, the foam or the resilient layer are provided with a filler according to the invention, and only a partial or different cross-linking is achieved, one discovers to one's surprise that the acoustic qualities, in particular sound-absorption, are different dependent upon the degree of cross-linking. Consequently it is possible, during the manufacturing of sound-absorbing wall-lining, to control, in a single procedure, the cross-linking in a distinctive way—particularly when polyol is used as a cross-linking agent—so that certain surface areas of the sound-absorbing wall-lining will, on purpose, have different sound-absorbing capacities than other surface areas. This can be achieved in particular while the thickness remains uniform. Moreover, the wall-lining can be manufactured in the form of sheet bars, i.e. flat strips, as well as in formed units.

By cross-linking we mean the spatial union of polymer chains, or similar, with each other, so that a network of polymers is formed. Cross-linking of this type also causes synthetic materials to harden. Increased ramification of the chains yields a higher degree of cross-linking and, consequently, a greater degree of hardness of the final product. Substances which convey linear molecule chains of macromolecular substances to active centers, for the erection of intermolecular bridges, thereby yielding networks with a 3-dimensional structure, are defined as cross-linking agents. They can either be incorporated into the network in the form of intermolecular bridges, or they can activate a direct union of active centers from chain to chain.

In practical applications, one should first determine empirically which areas of a sound-absorbing wall-lining require a higher or a lower sound-absorbing capacity. On that basis, one will be able, during the manufacturing in series of similar sound-absorbing wall-lining, to apply the cross-linking treatment with a set purpose.

Figure 2:
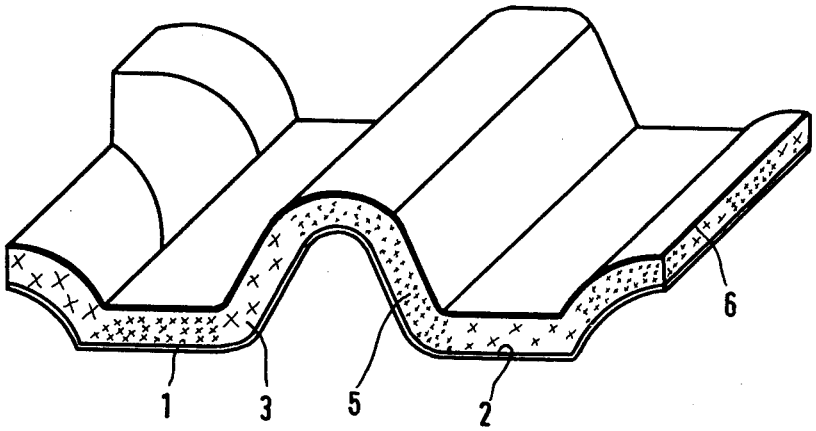

The drawings show examples of forms of execution of the invention. The figures show schematic representations of:

FIGS. 1 and 2 each show a sound-absorbing wall-lining of a different form, applied to part of a wall composed of a contoured piece of sheet metal; the wall-lining can also be defined as a sound-absorbing panel.

The sheet metal forming part of the wall 1 has contours which are matched by the wall-lining 3, which is designed as a formed unit, whereby nearly always the same thickness is maintained for the wall-lining 3. The wall-lining 3 can either be placed over the sheet metal, or it can be glued to it by means of an adhesive 2, as shown here.

The wall-lining 3 consists, as known, of a so-called resilient layer 4, 5 of foam, felt, or similar material, and a material 6 of a filled synthetic product, which forms a dense layer.

According to the invention, locally distinctive sound-absorbing capacities have been achieved by means of locally distinctive degrees of cross-linking of the resilient layer 4, 5.

When the degree of cross-linking is low, i.e. when there is only a small portion of a cross-linking agent such as polyol, in the filler of the foam, the resilient layer 4 will be soft; whereas a higher degree of cross-linking, due to a higher portion of the cross-linking agent, will result in a comparably hard resilient layer 5.

It is clear that the degree of cross-linking and, therefore, the sound-absorbing capacity, can, in practice, be changed gradually during the manufacturing of the wall-lining 3, i.e. by controlling the mixture ratios of the filler and the cross-linking agent accordingly. Considering that the thickness will essentially remain uniform, and that the sound-absorbing capacity will be locally distinctive, only one single, simple procedure will be required.

I claim:

1. A sound insulating wall-lining having uniform thickness and locally distinctive sound insulating properties and comprising a resilient layer such as a foam or a felt containing a filler material and characterized by the fact that said locally distinctive sound insulating properties are caused by and correspond to locally distinctive degrees of chemical cross-linking in the filler material.

2. Sound-insulating wall-lining according to claim 1, characterized by the fact that, for cross-linking purposes, the filler has been mixed with a polyol as cross-linking agent, and that the sound-insulating properties correspond to locally distinctive mixture ratios.

3. The sound insulating wall-lining of claim 1 or 2 in association with a substrate comprising a wall-forming material.

4. The sound insulating wall-lining of claim 3 wherein the association is effected by means of an adhesive.

5. Sound-insulating wall-lining according to one of the claims 1 or 2, characterized by the fact that the wall-lining is designed as a formed unit.

* * * * *